US007207376B2

(12) United States Patent
Dyhr

(10) Patent No.: US 7,207,376 B2
(45) Date of Patent: Apr. 24, 2007

(54) DUAL SCRAPED, THIN FILM, HEAT EXCHANGER FOR VISCOUS FLUID

(75) Inventor: Einar Dyhr, Holte (DK)

(73) Assignee: Delta Process Engineering APS, Holte (DK)

( * ) Notice: Subject to any disclaimer, the term of this patent is extended or adjusted under 35 U.S.C. 154(b) by 73 days.

(21) Appl. No.: 10/545,775

(22) PCT Filed: Feb. 9, 2004

(86) PCT No.: PCT/DK2004/000089

§ 371 (c)(1),
(2), (4) Date: Aug. 17, 2005

(87) PCT Pub. No.: WO2004/076955

PCT Pub. Date: Sep. 10, 2004

(65) Prior Publication Data

US 2006/0151152 A1 Jul. 13, 2006

(30) Foreign Application Priority Data

Feb. 26, 2003 (DK) ..... PA 2003 00292

(51) Int. Cl.
*F28D 11/02* (2006.01)

(52) U.S. Cl. ..... 165/91; 165/92

(58) Field of Classification Search ..... 165/90, 165/91, 92, 94
See application file for complete search history.

(56) References Cited

U.S. PATENT DOCUMENTS 1,930,808 A * 10/1933 Hulbert ..... 165/90
1,953,740 A * 4/1934 Baker et al. ..... 165/91
2,281,944 A 5/1942 Miller et al.
2,589,350 A 3/1952 Edmunds, Jr.
3,206,287 A * 9/1965 Crawford ..... 165/94
3,235,002 A * 2/1966 Bevarly et al. ..... 165/94
3,430,928 A * 3/1969 Smith ..... 165/94
3,495,951 A * 2/1970 Tanaka et al. ..... 165/91
3,805,406 A * 4/1974 Castonoli ..... 165/90
4,126,177 A * 11/1978 Smith et al. ..... 165/91

FOREIGN PATENT DOCUMENTS

DE 1 121 091 B 1/1962
EP 0053586 A 6/1982
FR 2 067 729 A 8/1971

* cited by examiner

*Primary Examiner*—Teresa J. Walberg
(74) *Attorney, Agent, or Firm*—Klein, O'Neill & Singh, LLP; Howard J. Klein

(57) ABSTRACT

A heat exchanger for viscous fluids includes a pair of frustum-shaped bodies (1) and (2) providing the heat-transmitting surfaces. The outer body is confined by gate-flanges (3) and (4) through which is inserted a bearing-and-seal housing (5). The inner body has a hollow center shaft (6) extending through the housing (5). The inner and outer bodies have one or more surface grooves (7). The outer body includes a jacket chamber (8) for a secondary, heat transfer fluid. The inner body is hollow, with channels to improve heat transfer, and the secondary fluid enters and exits through the hollow shaft (6). The angular movement of the inner body is also transferred through the shaft from an outside lever (9). The width of the grooves may exceed that of the scraper, allowing for relative radial movement of the scraper inside the groove. An axial force can be applied to increase the surface pressure of the scrapers.

6 Claims, 2 Drawing Sheets

DUAL SCRAPED, THIN FILM, HEAT EXCHANGER FOR VISCOUS FLUID

CROSS-REFERENCE TO RELATED APPLICATION

This application is a national stage filing, under 35 U.S.C. §371, of International Application No. PCT/DK2004/000089, filed 9 Feb. 2004, the disclosure of which is incorporated herein by reference.

FEDRALLY-SPONSORED RESEARCH OR DEVELOPMENT

Not Applicable

BACKGROUND OF THE INVENTION

The invention relates to a heat exchanger for efficient transfer of heat between a thin film of primary fluid and a secondary fluid or vapour, and to a method of heating or cooling of liquids, especially those with high viscosity, which have a tendency to solidify on the heat-transmitting surface, and where scraping of said surface is essential for an optimum heat transfer.

Flowing of highly viscous liquids tends to be laminar, which means that most of the heat transferred to the fluid from a heat-transmitting surface will be conductive. Agitation can more or less alter the laminar flow to turbulent flow and thereby increase the convectional heat transmission. In very viscous liquids, it is very hard to create much of a turbulent flow within the confines of the heat exchanger, and thus most of the heat transfer will be conductive. In these cases it is essential that the layer of liquid be heated is as thin as possible.

To increase the heating area, some heat exchangers are built with double walls, such that the liquid flows between two heat-transferring walls. This obviously increases the efficiency of the heat exchanger.

Some liquids tend to solidify on the heating surface, thus retarding the conductive heat process by building an insulating layer of product on the heat-conducting wall. This obviously reduces the efficiency of the heat exchanger.

Installing means to scrape the heat conductive surface often solves this problem. The scraped heat exchangers which are described in the patent literature can de divided into three basic categories: (1) those with single or dual scraped surfaces; (2) those with rotating or linear scraper movement; and (3) those with product propelled or foreign propelled scrapers.

A scraped heat exchanger much similar to the one here described is disclosed by R. L. Smith in U.S. Pat. No. 3,430,928, where the scrapers are imbedded into a rotating inner shaft. The main differences are that the machine here described has the facility for scraping both surfaces, and the force applied to the scraper to enhance the scraping action comes from axial forces applied from the outside rather than the centrifugal forces applied to the scrapers in the cited patent.

Douglas W. P. Smith in his U.S. Pat. No. 5,228,503 describes a dual scraped surface heat exchanger where a helically-formed auger on which scrapers are mounted is located in the annulus between two stationary cylinders. As the viscous liquid is pumped into the annulus the flow will affect the helical auger and it will start rotating. The rotating helical auger has two purposes 1) to create a turbulent flow; and 2) to scrape the two surfaces by means of scrapers affixed to the helical auger.

U.S. Pat. No. 4,126,177 to Robert L. Smith describes a similar machine with an external power source to drive the helical auger. The disadvantage of both the inventions is that the annular space required for the auger and scrapers limits possibility for thin film fluid processing. This is particularly a problem with highly viscous products, such as licorice, which tends to behave as in laminar flow if not forcibly agitated. Thus to agitate such product will require a very rigid, and consequently a space consuming, agitator. With such liquids it is sometimes an advantage to maintain the laminar flow in a thin film while keeping the dual heat transmitting surfaces scraped. In such a system the proximity of the surfaces is essential to the transfer of heat by conductivity. In none of the cited inventions is this possible.

SUMMARY OF THE INVENTION

In the present invention, the exchanger has an annular passage formed between an inner body and an outer body. The primary fluid passes through the annular passage and the secondary fluid passes through both the inside of the inner body and the outside casing of the outer body. The inner body, being capable of partial movement, has one or more equally spaced longitudinal grooves in which are installed scraper blades. The outer body has on its inner surface also the same equally spaced groves with similar scraper blades installed. Both bodies can be matching, coaxial frustums, spheres or wedges and the distance that the scraper blade protrudes from the groove is equal to the annular thickness or film thickness desired. By rotating or sliding the inner body or outer body back and forth covering the distance between the scrapers, the entire areas on both the inner and outer surfaces are scraped. Pressure exerted perpendicular to the scraping action will increase the scraping effect. The invention allows a thin film of liquid to be heated or cooled between two scraped surfaces by conductivity, which at the same time only requires a relatively small volume of liquid inside the heat exchanger, resulting in a reduced loss of product compared to other heat exchangers.

By allowing only a thin film of liquid to be treated at one time, the invention increases the efficiency of conductive heat transfer. Also, by use of the thin film to minimize the annulus volume, the amount of product trapped and lost at the end of each process cycle is minimized.

Another important problem with the cited and many other heat exchangers is their relatively large internal volume, which during the end of each cycle will contain much valuable product, which in most cases is lost in the subsequent cleaning operation. The object of the invention is to efficiently heat or cool a viscous liquid in laminar flow and to do this even when the liquid solidifies on the heat conductive surfaces.

According to the invention this is achieved by forcing the liquid into the annulus of two geometrically matching bodies; for clarity the description here will be two cylinders, where one of the cylinders is stationary and the other cylinder can rotate around its longitudinal axis. Both cylinders have means of heating or cooling their respective walls forming the annulus. To facilitate dual scraping of the surfaces, each wall has one or more evenly spaced grooves or slots, which extend along the entire length of the cylinder, and in each of which there is inserted a strip of scraping material. Said scraper penetrates into the annulus and touches the opposing wall. Since each scraper is imbedded in the wall by means of a groove, there is no requirement for external fixtures that occupy space in the annulus; thus the distance between the two cylinders can be very small and approach zero. To prevent the scrapers on the inner and outer walls from colliding when one of the cylinders is turning, the turning cylinder only rotates in an angle less than the equivalent of the angular division of the evenly spread scrapers. In other words, if there are 4 scrapers on each cylinder, then the cylinder reciprocates less than 90°.

To facilitate the exertion of a variable force on the scrapers, and at the same time to compensate for wear of the scrapers, a pair of matching frustum bodies, where the bodies can be forced together by an axial force coming from outside, can replace the cylindrical bodies. This also allows for easy changing of scraper thickness to accommodate the film thickness required for various products.

DETAILED DESCRIPTION OF THE INVENTION

Figure 1:
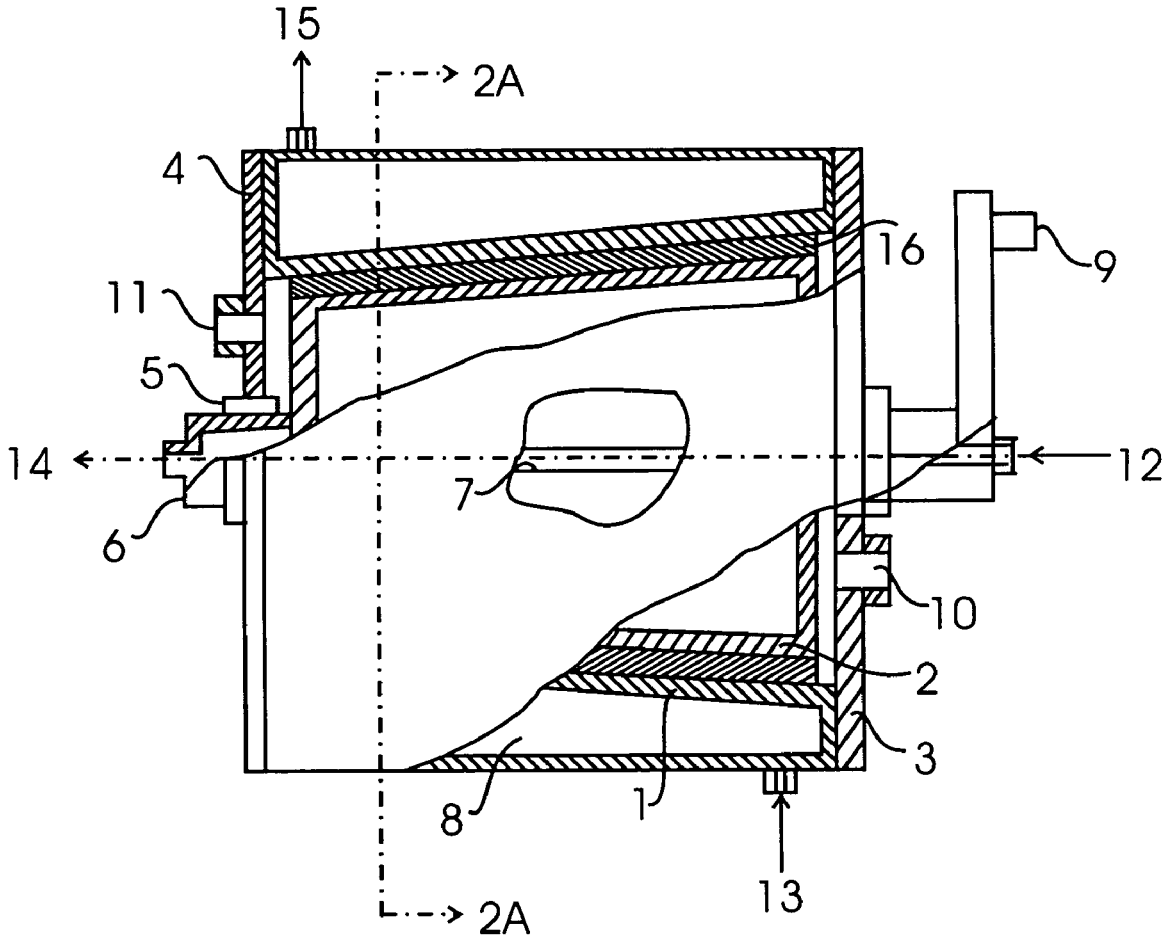
FIG. 1 is an elevational view, partially in section, of a heat exchanger in accordance with the present invention.

A practical example of the invention is shown in FIG. 1, where a matching set of frustum shaped bodies 1 and 2 form the heat-transmitting surfaces. The outer body is on both ends confined by gate-flanges 3 and 4, in the center of which there is inserted a bearing and seal housing 5. The inner body 1 has a longitudinal center shaft 6, which protrudes through the bearing and seal housing. Both inner and outer frustums 1, 2 have one or more grooves 7 in the surface, which extend a sufficient distance into the body wall. Such grooves could typically be of a dovetail shape to lock a scraper strip 16 in place. The outer body 2 is equipped with a jacket chamber 8 in which a secondary liquid or vapor delivers or retrieves heat. The inner body 1 is basically hollow, with channels to improve heat transfer, and the secondary fluid or vapor enters and exits through the hollow shaft 6.

The angular movement of the inner body 1 is also transferred through the same shaft 6 from an outside lever or crankshaft 9. The liquid to be processed enters the exchanger at 10 and exits at 11. The secondary liquid or gas enters the inner and outer bodies at 12 and 13, and exits at 14 and 15. An outside axial force can be applied at 12 or 14 to increase or decrease the surface pressure of the scrapers.

Figure 2B:
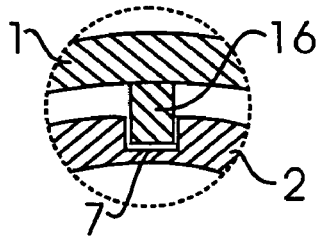
FIG. 2B is an enlarged, detailed view of the portion of FIG. 2A within the dashed circle B.
Figure 2A:
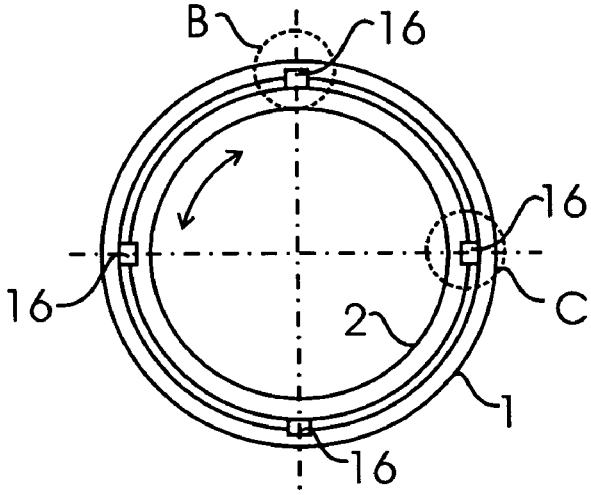
FIG. 2A is a cross-sectional view taken along line 2—2 of FIG. 1.
Figure 2C:
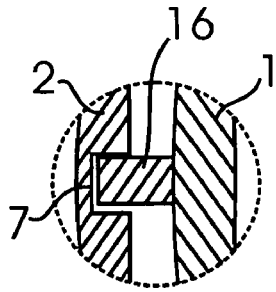
FIG. 2C is an enlarged, detailed view of the portion of FIG. 2A within the dashed circle C.

FIG. 2A shows a heat exchanger having four strands of scrapers 16 distributed with 90° angular spacing.

The matching bodies can also be spherical or shaped as wedges moving back and forth.

Figure 3:
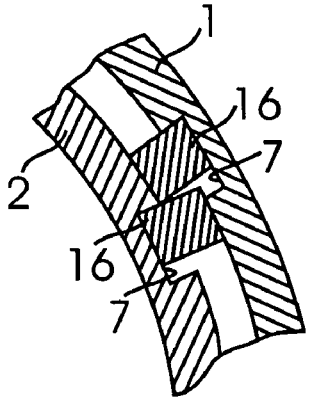
FIG. 3 is a detailed cross-sectional view of a modified form of the heat exchanger of the present invention.

In a further refinement shown in FIG. 3, the grooves are made wider than the scrapers. This allows the scrapers to over-lap, causing a movement of the scrapers relative to the groove. Adjusting the angle of rotation can cause the inner and outer scrapers to collide, thus pushing them from one edge of the widened groove to the other at each stroke. This feature will allow the scrapers not only to sweep the entire non-grooved surface, but also partially sweep the grooves themselves.

Radially-mounted scrapers following the same concept as above may be employed to dually scrape the radial surfaces of the inner bodies. This concept, however, introduces more complicated structures. A more simple way to avoid product build-up on the radial surfaces is to keep them relatively tempered by isolating them from the heating and cooling medium.

Another version of the heat exchanger has multiple strands of narrow scrapers which only require a very small angular movement to scrape the surface. The angular movement can then be done at a frequency approaching the ultrasonic spectrum. This will have the added advantage of aiding the flow of extremely viscous fluids through the exchanger by introducing a pumping action.

The invention claimed is:

1. An apparatus for heating and cooling a liquid by exposing said liquid to an annulus between two scraped surfaces, each having a substantially different temperature relative to said liquid, said apparatus comprising:

an outer body having a first surface, and having first and second ends each closed by a gate wall;

an inner body having a wall with a second surface and arranged within said outer body with said second surface facing said first surface to create said annulus forming an annular transfer passage having an inner wall defined by said second surface and an outer wall defined by said first surface of said outer body for receiving said fluid to undergo heat exchange;

means for effecting heat exchange with said annular passage from inside a cavity in the inner body and from outside a cavity in the outer body;

inlet and outlet passages communicating with said annular passage to allow for introduction and removal of said fluid to undergo heat exchange;

means for scraping said first and second surfaces comprising one or more strands of longitudinal scrapers protruding from longitudinal grooves in said inner wall and said outer wall; and means for applying a reciprocal angular movement of said inner body and said outer body in relation to each other in such a way that the relative angular movement of said first and second surfaces is implemented without collision between said scrapers in said inner wall and said scrapers in said outer wall, such angular movement being a function of the number of scraper elements in each respective body wall.

2. A heat exchanger as claimed in claim 1, wherein said walls of the inner and outer bodies define matching coaxial geometrical shapes such as frustums or spheres, wherein by relative axial movement between said walls the annulus thickness can be varied, which allows for varying thickness of the scrapers and the ability of varying the surface pressure between the scrapers and the scraped surfaces by applying an axial force from outside one of the inner body and the outer body.

3. A heat exchanger as claimed in claim 1, wherein said longitudinal grooves are substantially wider than the scrapers to allow for relative angular movement of the scrapers and the groove.

4. A heat exchanger as claimed in claim 1, wherein the distances between the longitudinal grooves are minimized to a point where the angular movement of the scraper approaches zero.

5. A heat exchanger as claimed in claim 2, wherein the distances between the longitudinal grooves are minimized to a point where the angular movement of the scraper approaches zero.

6. A method for processing a liquid or paste, said method comprising the steps of:

(a) providing an apparatus according to claim 1;

(b) introducing a heat exchange medium into said outer body and said inner body for heating or cooling said first and second surfaces; and (c) introducing said liquid or paste to be processed into said annular passage.

* * * * *